United States Patent [19]

Timari

[11] Patent Number: 4,571,871

[45] Date of Patent: Feb. 25, 1986

[54] U-SHAPED SUPPORT AND PIVOTAL LEVER FOR FIXING A BARREL TO THE BODY OF A FIREARM

[76] Inventor: Jali Timari, Hatanpäänvaltatie 32, SF-33100 Tampere 10, Finland

[21] Appl. No.: 551,999

[22] PCT Filed: Feb. 25, 1983

[86] PCT No.: PCT/FI83/00018

§ 371 Date: Oct. 24, 1983

§ 102(e) Date: Oct. 24, 1983

[87] PCT Pub. No.: WO83/02999

PCT Pub. Date: Sep. 1, 1983

[30] Foreign Application Priority Data

Feb. 26, 1982 [FI] Finland ..... 820714

[51] Int. Cl.[4] ..... F41C 21/22

[52] U.S. Cl. ..... 42/75 A

[58] Field of Search ..... 42/75 A, 75 B, 77; 89/29

[56] References Cited

U.S. PATENT DOCUMENTS

| | | | |
|---|---|---|---|
| 2,230,328 | 2/1941 | Krum et al. | 42/75 B |
| 2,437,137 | 3/1948 | Swebilius | 42/75 |
| 2,455,608 | 12/1948 | Rosengren | 42/75 |
| 2,625,766 | 1/1953 | Simpson | 42/75 |
| 2,702,958 | 3/1955 | Boroszewski | 42/75 A |
| 2,717,465 | 9/1955 | Clark, Jr. et al. | 42/75 |

FOREIGN PATENT DOCUMENTS

| | | |
|---|---|---|
| 3014541 | 9/1981 | Fed. Rep. of Germany . |
| 736677 | 11/1932 | France . |
| 2017880 | 10/1979 | United Kingdom . |

OTHER PUBLICATIONS

George Chinn, *The Machine Gun,* vol. 4, U.S. Govt. Printing Office, 1955, p. 442.

*Primary Examiner*—Charles T. Jordan
*Assistant Examiner*—Ted L. Parr
*Attorney, Agent, or Firm*—Cohen, Pontani & Lieberman

[57] ABSTRACT

A fixing means for fixing the barrel (1) of a firearm to the body (2) of the firearm. The object is to provide a fixing means which is simpler and easier to operate, and less expensive, fixing mechanisms of prior art.

As taught by the invention, the fixing means comprises a cradle-like, U-shaped fork (5) suspended by its two legs (6) to be borne by the body (2) and on the bottom (7) of which the barrel (1) has been disposed to be borne, and a fixing member (8) arranged to fix the barrel against the bottom of the fork. The fixing member (8) consists to advantage of an eccentric lever, for instance the upper housing of the firearm, and it comprises an eccentric locking member (9) disposed to press the barrel (1) against said bottom of the fork when the lever is turned into the locking position. The eccentric lever is, when desired, pivotally attached to the body with the aid of said axle pin. On the barrel (1) is preferably provided a notch (12), and the bottom (7) of the fork (5) or alternatively the fixing member (8) has been fitted to enter said notch to lock the barrel unturnably to the fork.

7 Claims, 5 Drawing Figures

U-SHAPED SUPPORT AND PIVOTAL LEVER FOR FIXING A BARREL TO THE BODY OF A FIREARM

BACKGROUND OF THE INVENTION

The present invention concerns a fixing means for fixing a barrel to the body of a firearm, said firearm further comprising an obturation mechanism and a cocking and fixing mechanism. In particular, the invention concerns a fixing mechanism for fixing the barrel to the body of the firearm for use in connection with small-calibre single-round and continuously firing, automatic arms.

Known fixing means and mechanisms attaching the barrel to hand firearms are complicated and frequently difficult to disassemble, i.e., the barrel is difficult to detach and to remount e.g. in connection with cleaning of the gun or when changing the barrel.

It is an object of the invention to provide a new kind of fixing means and mechanism for fixing the barrel to the body in particular for light—e.g. calibre less than 11 mm—automatic and mainly hand firearms, which means enables the barrel to be easily and rapidly detached and likewise to be easily and rapidly remounted. It is a further object of the invention to provide a fixing means that is simpler that any barrel fixing means known in the art.

SUMMARY OF THE INVENTION

The invention is based on fixing the barrel in support of the body with the aid of a particular, cradlelike and mainly U-shaped fork and attaching it to said fork with the aid of a fixing member. The fixing member consists of an eccentric lever disposed in the immediate vicinity of the barrel's muzzle part and which has been arranged in its locked position to press the barrel against the bottom of the fork. The barrel is preferably provided with a groove or notch and the bottom of the fork, or alternatively the eccentric locking member of the fixing member, has been fitted to enter said notch and thereby to lock the barrel unturnably fast to the fork.

Advantageously, the fixing means is so disposed on the muzzle part of the barrel that said notch or groove does not detract from the strength of the barrel in its highpressure portion.

BRIEF DESCRIPTION OF THE DRAWINGS

The invention is described in detail in the following with the aid of an embodiment example, referring to the attached drawing, wherein.

Figure 1:
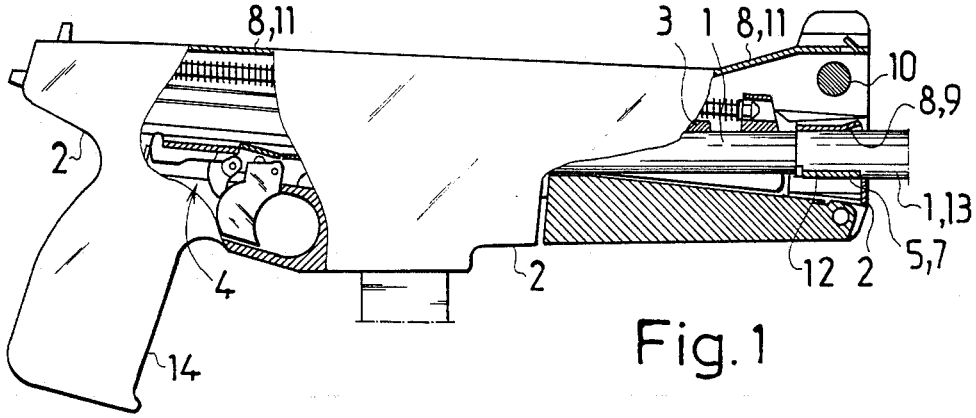
FIG. 1 presents in elevational view and partly sectioned, an automatic firearm according to the invention.
Figure 2:
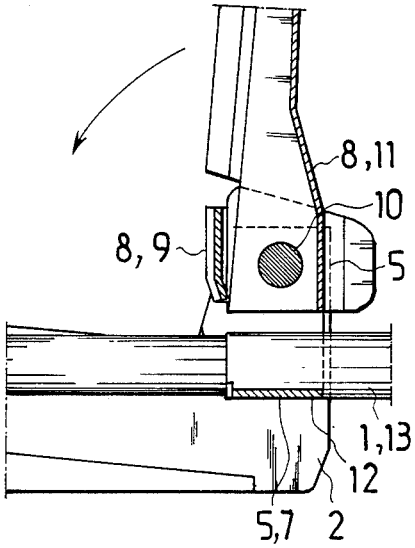
FIG. 2 presents in elevational view and partly sectioned, the barrel fixing means of the firearm of FIG. 1.
Figure 3:
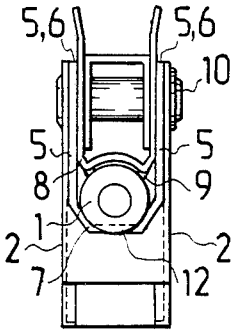
FIG. 3 presents the fixing of the barrel of firearm of FIGS. 1 and 2, viewed from the direction of the muzzle.

The automatic mechanical firearm depicted in FIGS. 1–3 comprises a body 2 provided with handle 14, with obturation mechanism 3 and with cocking and firing mechanism 4; the mode of functioning both of the obturation mechanism and the cocking and firing mechanism is conventional and shall not be more closely described here. The firearm furthermore comprises a barrel 1, which has been attached to the body 2 by the aid of a fixing means.

As taught by the invention, the fixing means comprises a mainly U-shaped fork 5 which has by its legs 6 been fixed to be borne by the body 2. The barrel 1 has been installed to be borne by the bottom or bridge 7 of the fork 5 and it has been fixed against said fork bottom with the aid of a fixing member 8. The fork 5 has been suspended by its legs 6 with the aid of a horizontal axle pin 10 placed above the barrel 1 and transversal to the barrel. The fixing member 8 urges the barrel 1 against the bottom 7 of the fork 5. On the barrel 1, a notch 12 has been provided, and the bottom of the fork 5 has been fitted to enter this notch to lock the barrel unturnably to the fork.

In the embodiment just presented, the fixing member 8 consists of an eccentric lever, that is part of the top housing 11 of the firearm, which has been pivoted to the body 2 of the firearm to be turnable in the vertical plane placed to pass through the barrel 1, this pivotal attachment being accomplished by the abovementioned axle pin 10 which also fixes the fork 5 to the body 2 by its legs 6. The eccentric lever 8 is to provided with an eccentric locking member 9 which is disposed to urge the barrel 1 against the bottom of the fork 5 when the lever is turned into the locking position. In FIG. 2, the eccentric lever 8 is shown in opened position, i.e., turned to be upright with reference to the barrel 1 and at right angles to the barrel. The eccentric locking member 9 is then likewise upturned and out of contact with the barrel 1. In FIG. 1, the eccentric lever 8 has been turned down, and the locking member 9 has descended against the top surface of the barrel 1, at the same time pressing the barrel against the bottom 7 of the fork 5.

In the embodiment shown in FIGS. 1–3, the fixing means fixes the barrel 1 to the body 2 by the muzzle part 13 of the barrel. In that case, the notch 12 made in the barrel 1 for the bottom 7 of the fork 5 will not coincide with the high-pressure portion of the barrel. The bottom 7 of the fork 5 has been fitted into the notch 12 provided on the barrel so that the fork will lock the barrel, with the aid of said notch, fast to the body unturnably and immovably in the longitudinal direction. The notch 12 has a flat bottom, and the bottom 5 of the fork 5 is likewise of planar shape.

Figure 5:
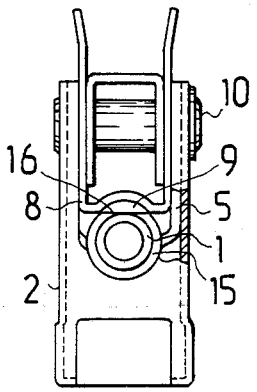
FIG. 5 presents the fixing of the barrel of the firearm of FIG. 4, viewed from the direction of the muzzle.
Figure 4:
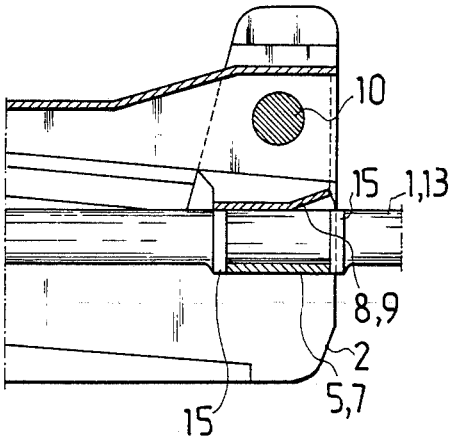
FIG. 4 presents in elevational view and partly sectioned, another barrel fixing means for an automatic firearm according to the invention.

In the embodiment shown in FIGS. 4–5, two substantially annular projections 15 have been provided on the muzzle portion 13 of the barrel 1. The bottom 7 of the fork 5 has been fitted to enter between the projections 15 formed on the barrel 1 so that the fork will lock the barrel with the aid of said projections to be immovable longitudinally. In this embodiment the bottom 7 of the fork 5 is curved consistent with the curvature of the barrel 1 and of the projections 15. On the topside of the barrel 1, at the projections 15, planar surfaces 16 have been provided flush with the surface of the barrel. Thereby the barrel 1 will be fixed by the fixing means unturnably to the body, because the locking member 9 presses the flat surfaces 16 of the projections and the upper surface of the barrel thereby pressing the barrel against the bottom 7 of the fork 5.

The embodiment of the invention are meant to be variable within the scope of the claims following below. The barrel may equally be fixed to the body at points other than its muzzle portion; if desired, a notch may be provided on the barrel also on the side of the fixing member 8, e.g. so that the eccentric locking member 9 is fitted into a notch made on the barrel to lock the barrel to the body unturnably and longitudinally immovably. It is further possible to provide a plurality of notches or grooves on the barrel in addition to the bottom of the fork and said locking member and/or in their stead for the side walls of the fork or for other fixing means. Furthermore, the fixing means may also consist of other kinds of fixing mechanism, for instance of a screw attachment known in itself in the art, etc. Furthermore, the fork may be attached to the body not only with its bottom pointing downward but alternatively equally with its bottom upward or to one or the other side.

I claim:

1. In a firearm having a body and an elongated barrel, the improvement comprising fixing means for releasably securing the barrel to the body of the firearm, said fixing means comprising:

axle pin means mounted to the body transverse to the elongation of the barrel;

a substantially U-shaped barrel supporting member comprising a pair of legs and a bridge connecting said legs, the legs of said supporting member being mounted to the firearm body at said axle pin means for receiving and supporting the barrel on said bridge;

an eccentric locking member pivotally secured to the firearm body at said axle pin means for pivotal movement relative to said body and to said supporting member between a first position remote from said supporting member and in which the barrel is freely movable into and out of operative position with respect to the body, and a second position nested within said supporting member for firmly pressing the barrel between the locking member and said supporting member bridge to thereby releasably secure the barrel to the firearm body.

2. In a firearm in accordance with claim 1, said eccentric locking member comprising at least a part of an upper housing of said firearm for cooperative engagement with said body in said second position of the locking member.

3. In a firearm in accordance with claim 1, said barrel having a notch defined therein for cooperative engagement with one of said supporting member and locking member to prevent unintended rotation of the barrel.

4. In a firearm in accordance with claim 1, said supporting member being mounted to said body so that the supporting member is substantially vertically disposed for receiving the barrel on said bridge and between said legs.

5. In a firearm in accordance with claim 4, said supporting member being mounted to the body so that, with the firearm oriented for normal use, the barrel rests atop said bridge.

6. In a firearm in accordance with claim 1, said eccentric locking member including a portion for pressing engagement with the barrel in opposition to said supporting member bridge and, in said second position of the locking member, said axle pin means, said locking member portion and said supporting member bridge being substantially aligned to prevent the application of torsional forces on the barrel by said fixing means.

7. In a firearm in accordance with claim 1 and further including a muzzle at the forward end of said barrel, said barrel being received and supported on said bridge proximate the muzzle so that, in said second position of said locking member, the barrel is firmly pressed between the locking member and said supporting member bridge proximate said muzzle.

* * * * *